US006857924B2

(12) United States Patent
Fu et al.

(10) Patent No.: US 6,857,924 B2
(45) Date of Patent: Feb. 22, 2005

(54) METHOD OF PRODUCING AN LED HOSE LIGHT

(76) Inventors: Ta-Hao Fu, No. 3, Lane 67, Guanghua E. St., 8 Lin, Jinhua Li, North Chiu, Hsinchu (TW); Chih-Wei Jen, 8 Fl., No. 11, Jungpo N.Rd., Shinyi Chiu, Taipei (TW)

( * ) Notice: Subject to any disclaimer, the term of this patent is extended or adjusted under 35 U.S.C. 154(b) by 425 days.

(21) Appl. No.: 10/158,840

(22) Filed: Jun. 3, 2002

(65) Prior Publication Data

US 2003/0224687 A1 Dec. 4, 2003

(51) Int. Cl.[7] ..... H01J 9/00; H05B 33/10
(52) U.S. Cl. ..... 445/24; 445/25
(58) Field of Search ..... 445/24, 25; 313/512

(56) References Cited

U.S. PATENT DOCUMENTS 4,915,666 A * 4/1990 Maleyko ..... 446/242
5,197,797 A * 3/1993 Jaksich ..... 362/219
6,188,527 B1 * 2/2001 Bohn ..... 257/100
6,583,550 B2 * 6/2003 Iwasa et al. ..... 313/485

* cited by examiner

*Primary Examiner*—Nimeshkumar D. Patel
*Assistant Examiner*—Mariceli Santiago

(57) ABSTRACT

A method of producing an LED hose light includes the steps of mounting a plurality of serially connected LED strings directly on a core tube, using an intermediate tube having embedded power cords for supplying power to the LED strings to enclose the core tube having the LED strings mounted thereon, so as to form an assembly of the core tube, the LED strings, and the intermediate tube, and extending the assembly of the core tube, the LED strings, and the intermediate tube through an outer tube. The LED hose light associating LED strings with the core tube is easily bendable and energy-saving and can be produced at largely reduced cost.

4 Claims, 5 Drawing Sheets

METHOD OF PRODUCING AN LED HOSE LIGHT

BACKGROUND OF THE INVENTION

The present invention relates to a method of producing a hose light, and more particularly to a method of associating light emitting diodes (LEDs) with a core tube to produce an easily bendable and highly energy-saving LED hose light at largely reduced manufacturing cost.

A conventional hose light includes a plurality of bulbs as its light sources. These bulbs are serially connected to one another to form one or two bulb strings, which are then set in a long core tube. In the case only one bulb string is formed, the bulbs are set in parallel with the core tube, and lead wires of the first and the last bulb in the bulb string are respectively connected to a positive and a negative power cord in the core tube, so that the bulbs are electrically made to emit light. And, in the case two bulb strings are formed, lead wires of the bulbs must be covered with insulated sleeves to avoid a short circuit.

In the above-described conventional hose light, the bulbs are horizontally set into the core tube via a longitudinal opening provided on one side of the core tube. The longitudinal opening largely reduces an overall structural strength of the core tube. When the hose light is used on a stage or at places close to steps and tends to be twisted, deformed, trodden or impacted, the core tube with reduced structural strength is not strong enough to bear such external forces, resulting in damaged bulbs in the core tube. Moreover, it is difficult and requires increased material and labor costs to mount the insulated sleeves around the lead wires of two adjacent bulb strings that are set in the core tube at the same time. The conventional hose light with two bulb strings is therefore not economical for use.

Another problem with the conventional hose light is that the bulbs consume high power and generate a large amount of heat to cause deteriorated core tube and outer tube of the hose light. Broken bulbs in the deteriorated core tube and outer tube tend to cause short circuit, and the conventional hose light is therefore not safe for use.

It is therefore tried by the inventor to develop a method for producing an improved hose light in which light emitting diodes are associated with a core tube to form an LED hose light that is easily bendable and highly energy-saving and can be produced at largely reduced cost.

SUMMARY OF THE INVENTION

A primary object of the present invention is to provide a method of producing an LED hose light, so that LEDs are associated with a core tube to form a highly flexible, plastically deformable, and energy-saving hose light that can be produced at largely reduce cost.

Another object of the present invention is to provide a method of producing an LED hose light that has enhanced bending strength and consumes very low power to ensure high safety in use.

To achieve the above and other objects, the method of the present invention for producing an LED hose light includes the steps of forming a plurality of serially connected LED strings directly on a core tube, using an intermediate tube having embedded power cords for supplying power to the LED strings to enclose the core tube having the LED strings mounted thereon, so as to form an assembly of the tube core, the LED strings, and the intermediate tube, and extending the assembly of the LED strings and the intermediate tube through an outer tube to be protectively enclosed in the outer tube.

In drawing the core tube, a longitudinal groove is cut along one side of the core tube, and a plurality of recesses are spaced along an opening of the groove.

Each of the LED string is produced by compressing a metal wire at different sections thereof; cutting each of the compressed sections into two plate electrodes; providing a chip on a first one of the two plate electrodes in each compressed section, and a lead wire on a second plate electrode to overlap a surface of the chip on the first plate electrode, so as to form a light emitting element on each compressed section of the metal wire; positioning the plurality of light emitting elements in the recesses formed on the core tube; using a transparent material to circumferentially enclose the core tube at positions having the recesses and the light emitting elements provided thereat; positioning the metal wire in the longitudinal groove while keeping the metal wire in a wavy line; and separately extending two outmost ends of the metal wire across a top of the opening of the longitudinal groove of the core tube.

The intermediate tube is formed from a plurality of serially connected transparent hollow tubular sections. Two power cords having different polarities are embedded in two opposite sides of a wall of the intermediate tube, and are exposed at joints of two adjacent tubular sections for the outmost ends of the metal wires of the LED strings to overlap thereat latter. An axial opening is formed at one side of each tubular section to allow quick positioning of the LED strings on the core tube into the tubular sections of the intermediate tube via the axial openings.

The outer tube is a hollow tubular member dimensioned to allow easy extending of the intermediate tube therethrough, so that the core tube, the LED strings, and the intermediate tube are protectively enclosed in the outer tube.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 7:
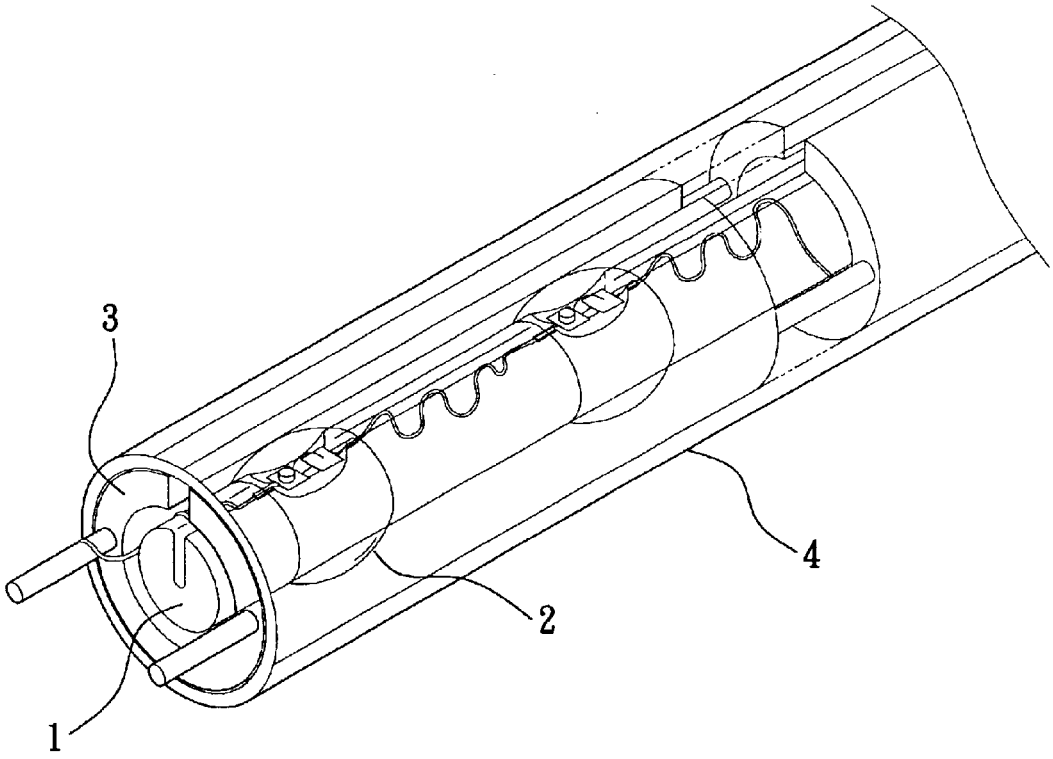
FIG. 7 shows a finished LED hose light formed by enclosing the assembly of FIG. 6 with an outer tube.

Please refer to FIG. 7 that shows a length of finished LED hose light formed in the method of the present invention and mainly includes a core tube 1, a plurality of serially connected LED strings 2 directly mounted on the core tube 1, an intermediate tube 3 enclosing the core tube 1, and a transparent outer tube 4 in which an assembly of the core tube 1 and the intermediate tube 3 is enclosed.

Figure 1:
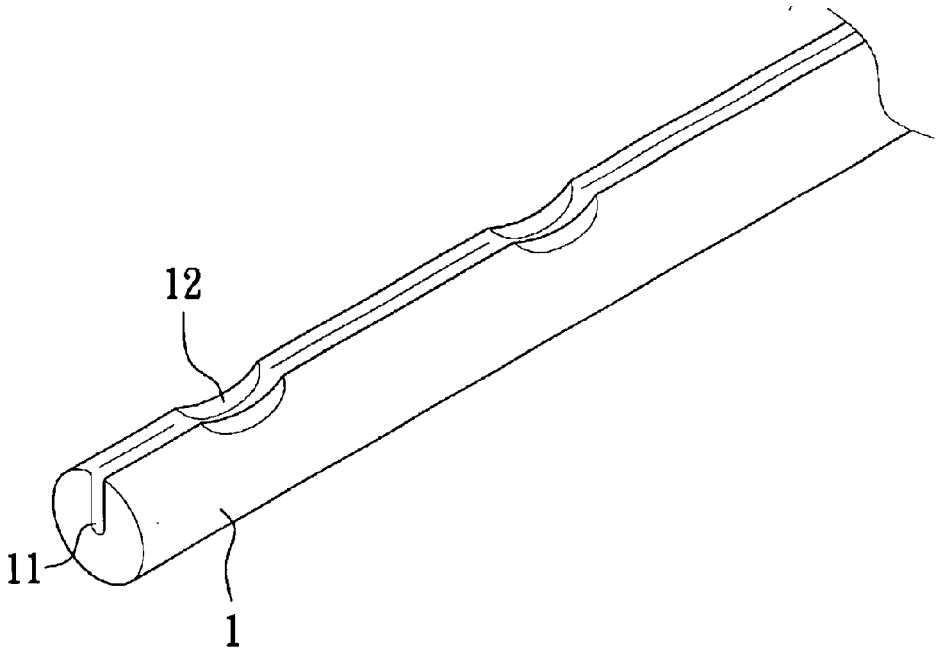
FIG. 1 shows a core tube used in forming an LED hose light in the method of the present invention.

The core tube 1 is produced by drawing a predetermined material into a desired tubular shape; cutting one side of the tubular shape to provide a longitudinal groove 11; and forming a plurality of recesses 12 spaced along an opening of the groove 11, as shown in FIG. 1.

Figure 2:
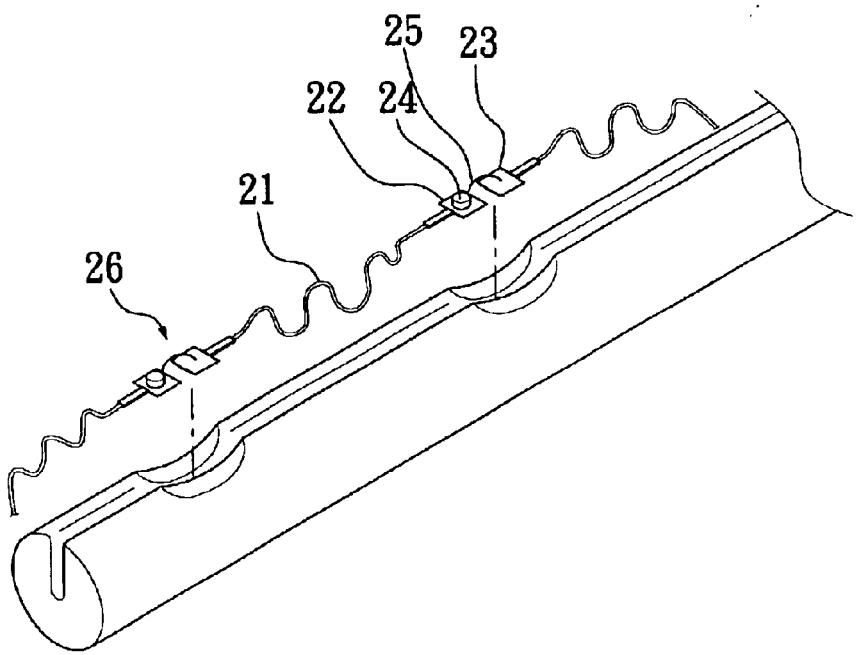
FIG. 2 shows an LED string for mounting on the core tube of FIG. 1 for forming the LED hose light.
Figure 3:
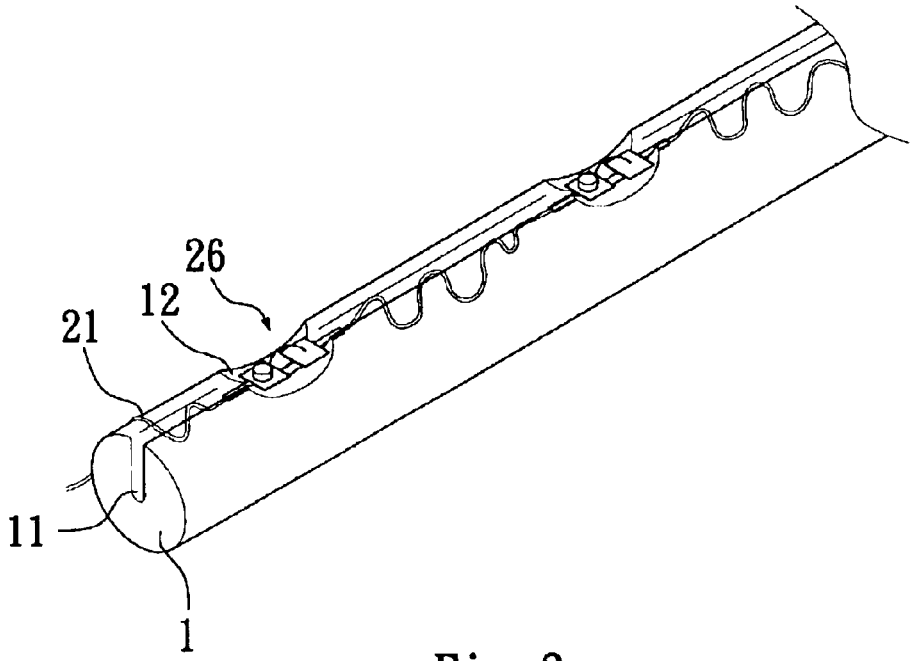
FIG. 3 shows the core tube of FIG. 1 with LED strings mounted thereon.
Figure 4:
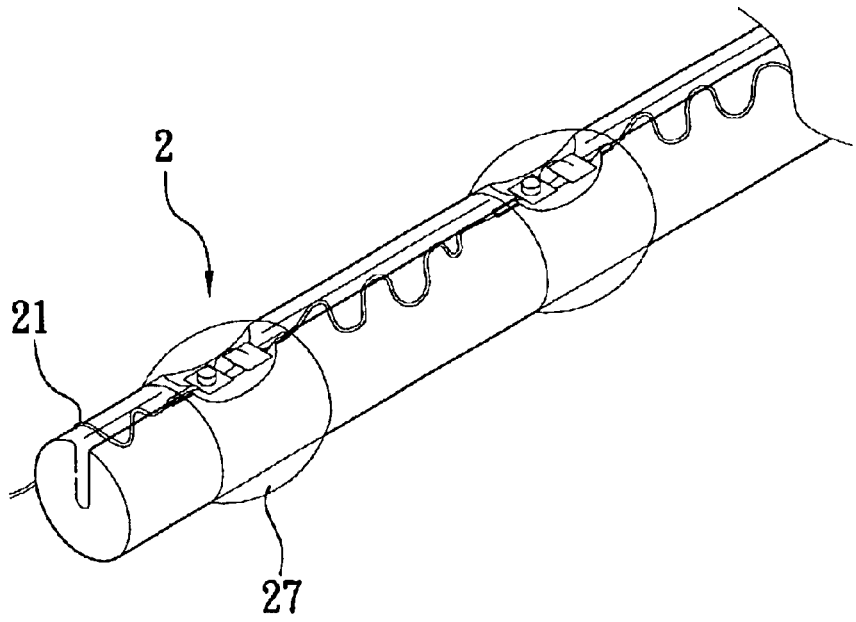
FIG. 4 shows positions on the core tube having LED strings mounted thereat are enclosed with protective transparent material.

Each of the LED strings 2 is produced by compressing a metal wire 21 at different sections; cutting each of the compressed sections into two plate electrodes 22, 23; providing a chip 24 on one of the two plate electrodes in each compressed section, such as the plate electrode 22, and a lead wire 25 on the other plate electrode 23 to overlap a surface of the chip 24 on the plate electrode 22, so as to form a light emitting element 26 on each compressed section of the metal wire 21, as shown in FIG. 2; separately positioning the plurality of light emitting elements 26 in the recesses 12 on the core tube 1, as shown in FIG. 3; using transparent epoxy resin 27 to circumferentially enclose the core tube 1 at positions having the recesses 12 and the light emitting elements 26 provided thereat; positioning the metal wire 21 in the groove 11 while keeping the metal wire 21 in a wavy state; and separately extending two outmost ends of the metal wire 21 across a top of the opening of the groove 11 of the core tube 1, as shown in FIG. 4.

Figure 5:
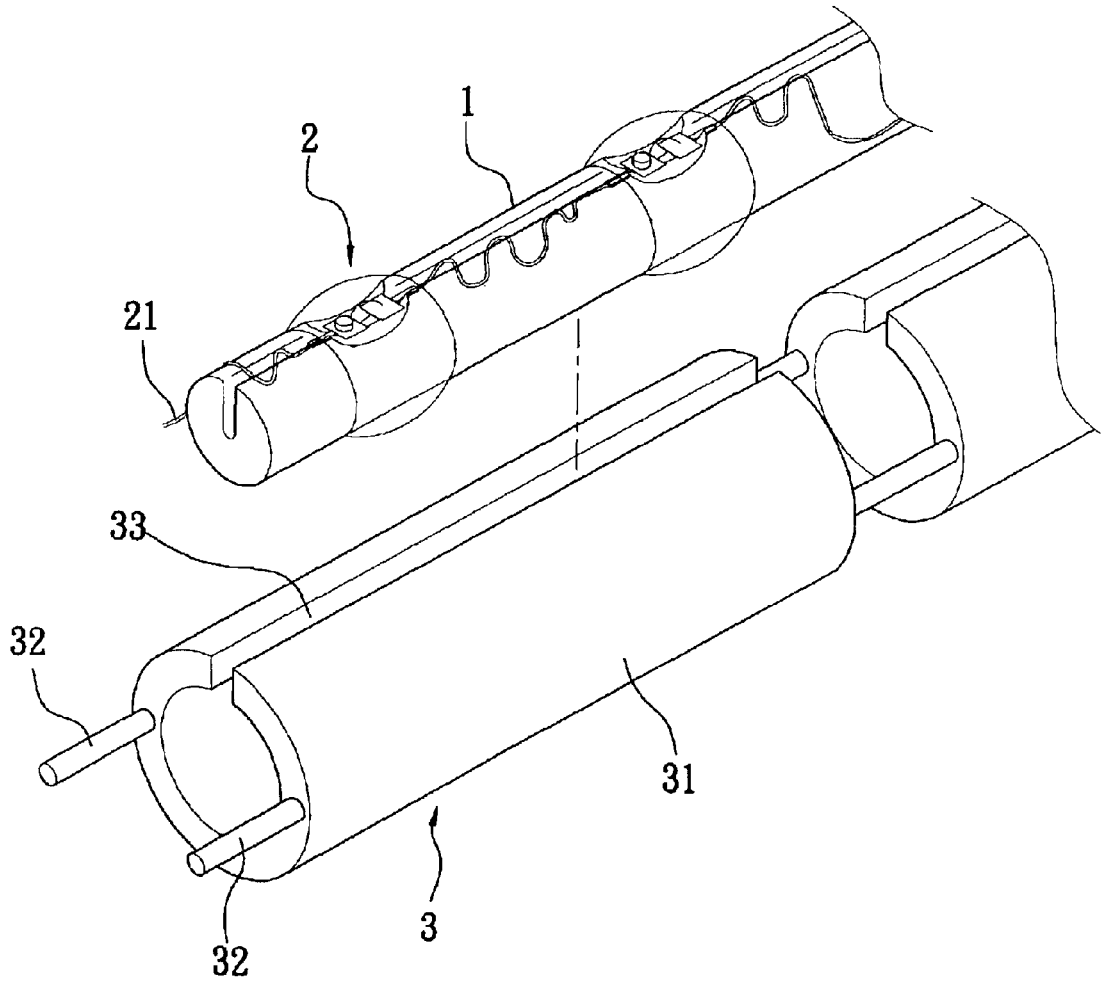
FIG. 5 shows an intermediate tube for enclosing the core tube of FIG. 4 for forming the LED hose light.
Figure 6:
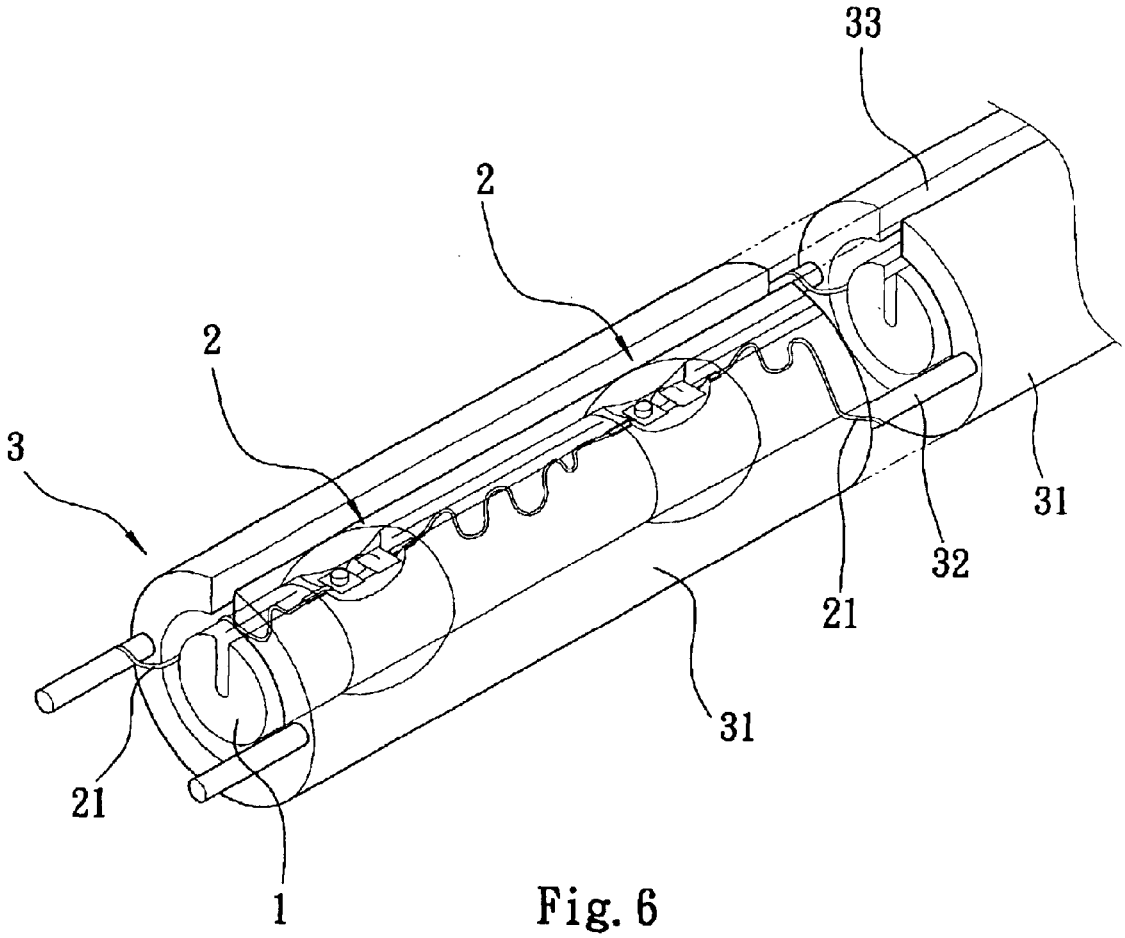
FIG. 6 shows an assembly of the intermediate tube of FIG. 5 and the core tube of FIG. 4.

The intermediate tube 3 is produced by serially connecting a plurality of transparent hollow tubular sections 31 to one another with two power cords 32 having different polarities and embedded in two opposite sides of walls of the tubular sections 31, so that the two power cords 32 are exposed from the intermediate tube 3 at joints of two adjacent tubular sections 31 for the outmost ends of the metal wires 21 of LED strings 2 to overlap thereat latter; and forming an axial opening 33 at one side of the wall of each tubular section 31 to allow quick positioning of the core tube 1 having the LED strings 2 thereon into the tubular sections 31 of the intermediate tube 3 via the axial openings 33, as shown in FIGS. 5 and 6.

The outer tube 4 is produced from a transparent hollow tubular member made of a plastic material, such as PVC or PET, and is dimensioned to enable easy extending of the intermediate tube 3 therethrough, so that an assembly of the core tube 1 having the LED strings 2 mounted thereon and the intermediate tube 3 is further protectively enclosed by the outer tube 4 to form a complete LED hose light, as shown in FIG. 7.

With the above-described arrangements, it is possible to quickly produce an LED hose light by mounting the LED strings 2 directly on the core tube 1, using the intermediate tube 3 to enclose the core tube 1 having the LED strings 2 mounted thereon, and using the outer tube 4 to enclose the intermediate tube 3 having the core tube 1 and the LED strings 2 enclosed therein. Since the intermediate tube 3 is provided with two power cords 32 for the metal wires 21 of the serially connected LED strings 2 to overlap thereat to obtain necessary power supply, a plurality of parallel circuits are formed between the two power cords 32.

It is to be noted that the metal wires 21 positioned in the groove 11 of the core tube 1 are maintained in a wavy line. The metal wires 21 in a wavy line provide sufficient buffering length for them to stretch or buckle when the hose light is bent.

The LED hose light produced in the method of the present invention associates LEDs with the core tube to largely reduce the manufacturing cost of the hose light while the resultant hose light is easily bendable and requires only low power consumption.

What is claimed is:

1. A method of producing an LED hose light, said LED hose light including a core tube, a plurality of serially connected LED strings directly mounted on said core tube, an intermediate tube enclosing said core tube, and a transparent outer tube enclosing said intermediate tube, comprising the steps of:

producing said core tube by drawing a predetermined material into a desired tubular shape; cutting one side of said tubular shape to provide a longitudinal groove; and forming a plurality of recesses spaced along an opening of said groove;

producing each of said LED strings by compressing a metal wire at different sections thereof; cutting each of said compressed sections into two plate electrodes; providing a chip on a first one of said two plate electrodes in each compressed section, and a lead wire on a second plate electrode to overlap a surface of said chip on said first plate electrode, so as to form a light emitting element on each said compressed section of said metal wire; positioning said plurality of light emitting elements in said recesses spaced on said core tube; using a transparent material to circumferentially enclose said core tube at positions having said recesses and said light emitting elements provided thereat; positioning said metal wire in said longitudinal groove while keeping said metal wire in a wavy line; and separately extending two outmost ends of said metal wire across a top of said opening of said longitudinal groove of said core tube;

producing said intermediate tube by serially connecting a plurality of transparent hollow tubular sections to one another with two power cords that have different polarities and are embedded in two opposite sides of walls of said tubular sections, so that said two power cords are exposed from said intermediate tube at joints of any two said tubular sections that are adjacent to each other for said outmost ends of said metal wires of said LED strings to overlap thereat latter; and forming an axial opening at one side of the wall of each said tubular section to allow quick positioning of said core tube having said LED strings mounted thereon into said tubular sections of said intermediate tube via said axial openings;

producing said outer tube with a transparent hollow tubular member that is made of a plastic material and dimensioned to enable easy extending of said intermediate tube therethrough;

positioning said core tube having said LED strings mounted thereon into said tubular sections of said intermediate tube via said axial openings on said tubular sections to form an assembly of said core tube, said LED strings, and said intermediate tube; and overlapping said outmost ends of said metal wire of each said LED string with said power cords exposed from joints of said adjacent tubular sections of said intermediate tube; and extending said assembly of said core tube, said LED strings, and said intermediate tube through said outer tube, so as to enclose said assembly in said outer tube to form a complete LED hose light.

2. The method of producing an LED hose light as claimed in claim 1, wherein said metal wire of each said LED string is positioned in said longitudinal groove of said core tube in a wavy line to provide a buffering length sufficient to allow said metal wire to stretch freely when said LED hose light is bent.

3. The method of producing an LED hose light as claimed in claim 1, wherein each of said LED strings includes a plurality of said light emitting elements that are serially connected to one another, and two outmost ends of said metal wires of a first and a last light emitting element in each said LED string are separately overlapped with said two power cords having different polarities, so that a plurality of parallelly connected LED strings are formed between said two power cords.

4. The method of producing an LED hose light as claimed in claim 1, wherein said transparent material for enclosing said core tube at said recesses and said light emitting elements comprises epoxy resin.

* * * * *